United States Patent [19]

Trowbridge et al.

[11] Patent Number: 4,631,989

[45] Date of Patent: Dec. 30, 1986

[54] RATCHET HANDLE FOR USE INTERCHANGEABLY WITH SOCKET WRENCHES HAVING COUPLING MEANS OF DIFFERENT SIZES

[75] Inventors: Craig A. Trowbridge, 7151 Apache Dr., Sedalia, Colo. 80135; Charles A. Trowbridge, Sedalia, Colo.

[73] Assignee: Craig A. Trowbridge, Denver, Colo.

[21] Appl. No.: 740,853

[22] Filed: Jun. 3, 1985

Related U.S. Application Data

[63] Continuation-in-part of Ser. No. 663,047, Oct. 19, 1984, abandoned.

[51] Int. Cl.[4] ..... C22B 1/00; C22C 1/00

[52] U.S. Cl. ..... 81/62; 81/177.85; 81/185; 81/439

[58] Field of Search ..... 81/62, 177.2, 177.85, 81/58.1, 439, 185

[56] References Cited

U.S. PATENT DOCUMENTS

| | | | |
|---|---|---|---|
| 854,742 | 5/1907 | Hill | 81/177.2 |
| 1,323,056 | 11/1919 | Hofmann | 81/177.85 |
| 1,578,065 | 3/1926 | Bemus et al. | 81/62 |
| 3,127,798 | 4/1964 | Gol . | |
| 3,208,318 | 9/1965 | Roberts | 81/177 |
| 3,258,998 | 7/1966 | Harper | 81/58.1 |
| 4,367,663 | 1/1983 | Merics . | |

*Primary Examiner*—Frederick R. Schmidt
*Assistant Examiner*—Bradley I. Vaught
*Attorney, Agent, or Firm*—Wm. Griffith Edwards

[57] ABSTRACT

A ratchet handle for use with socket wrenches includes a socket engaging projection on which socket wrenches having a first size of coupling socket can be mounted for turning by the handle. The handle includes a bar slidable within the projection and movable from a position within the projection to a second position with its end extending axially beyond the projection. Socket wrenches having a second and smaller size of coupling socket are mounted on the handle by engagement with the extended end of the bar. The bar is retained in either of two positions by spring pressed balls or detents which engage two shallow recesses in the projection in one position and in the extended position of the bar one of the detents lies outside the projection in position to engage a socket coupling mounted thereon. In another embodiment the bar is biased by a compression spring to its position within the projection and a cam on the bar urges a detent outwardly to retain the larger socket on the projection. A spring pressed detent at the end of the bar holds a smaller socket in place when the bar is in its extended position and the spring then has sufficient force to hold the bar in its extended position against the opposing force of the compression spring.

3 Claims, 7 Drawing Figures

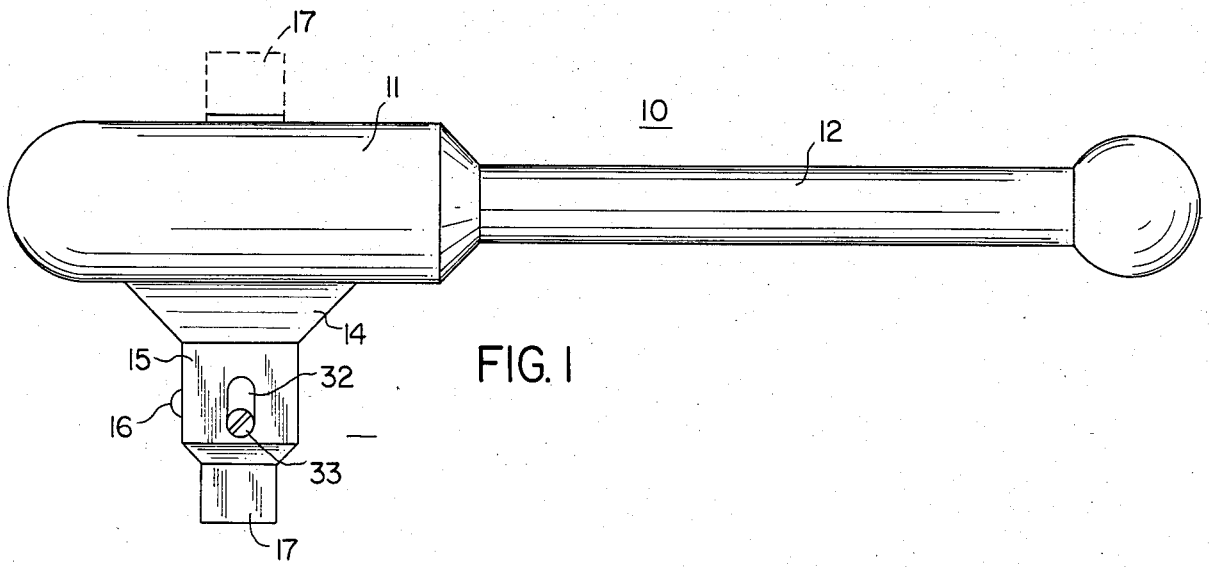
FIG. 1
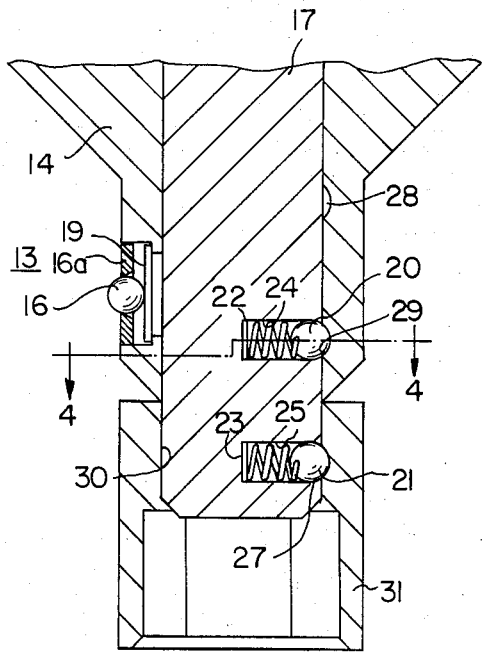
FIG. 2
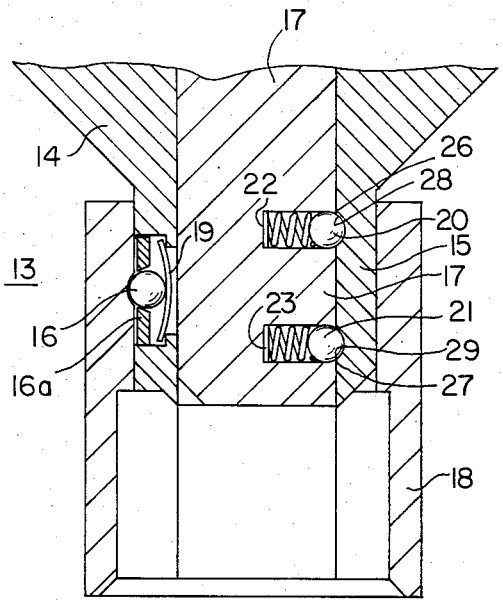
FIG. 3
FIG. 4
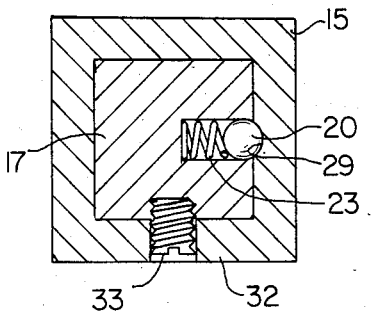

RATCHET HANDLE FOR USE INTERCHANGEABLY WITH SOCKET WRENCHES HAVING COUPLING MEANS OF DIFFERENT SIZES

This application is a continuation-in-part of copending application Serial No. 663,047, filed Oct. 19, 1984 now abandoned.

This invention relates to socket wrenches of the type commonly provided in sets comprising a ratchet handle and a plurality of sockets in a selected range of sizes, and the invention relates particularly to an improved ratchet handle for interchangeably with sockets having coupling heads of two different sizes.

BACKGROUND OF THE INVENTION

Automobile repair shops and the like normally require several sets of socket wrenches one or more of which sets have coupling heads of different sizes and separate ratchet handles are included for each set having a different size of coupling head. It is desirable to keep the respective handle with each set to avoid loss of time in locating the correct handle for the job at hand.

Heretofore screw driver or wrench devices have been provided that have multiple telescoping members or sections which may be moved longitudinally or axially with respect to one another to select a size of section for engagement with a screw head or a nut which is to be turned, the sections sliding with respect to one another until a section of the size of the nut or screw is reached, whereupon the nut or screw can be turned by turning the handle of the device.

A ratchet handle is commonly provided for use with the socket wrenches of a set, and various lengths of connector rods or extensions have also been provided for use interchangeably with the sockets to enable the wrench to reach and turn nuts or bolt heads at selected distances from the ratchet handle.

It is an object of the present invention to provide an improved ratchet handle for socket wrenches which is usable interchangeably with two sets of socket wrenches which have wrench socket couplings of different sizes.

It is another object of this invention to provide an improved ratchet handle for socket wrenches which may be quickly and positively adjusted for use with either of two sets of socket wrenches which sets have coupling sockets of different sizes.

BRIEF SUMMARY OF THE INVENTION

A ratchet handle for turning socket wrenches is provided with a projection for holding and driving a socket wrench having a coupling head of one size and is effective for use with a set of such socket wrenches. In order to make the handle effective for use with a set of socket wrenches having smaller coupling heads a second projection is provided which is slidably mounted within the first projection. The second projection may be moved axially outwardly of the first into a position for engaging a socket having a corresponding smaller coupling head socket. Thus the ratchet handle may be used interchangeably with socket wrenches from sets provided with two different sizes of coupling head sockets and the single ratchet handle is effective for use with either set of wrenches and avoids the necessity of providing two separate ratchet handles one for each set.

The features of novelty which characterize the invention are set forth in the appended claims. The invention itself, however, both as to its organization and method of operation, together with further objects and advantages thereof, may best be understood upon references to the following description taken in connection with the accompanying drawings.

BRIEF DESCRIPTION OF DRAWINGS

FIG. 1 is a side elevation view of a ratchet handle for socket wrenches which embodies the invention;

FIG. 2 is a somewhat diagrammatic sectional side elevation view through the center of the socket attaching projection of the device of FIG. 1 with a socket wrench having a small coupling head attached thereon;

FIG. 3 is a sectional view like that of FIG. 2 with the central bar retracted and a socket wrench having a larger coupling head attached thereon;

FIG. 4 is a sectional view along the line 4—4 of FIG. 2;

DETAILED DESCRIPTION

Figure 5:
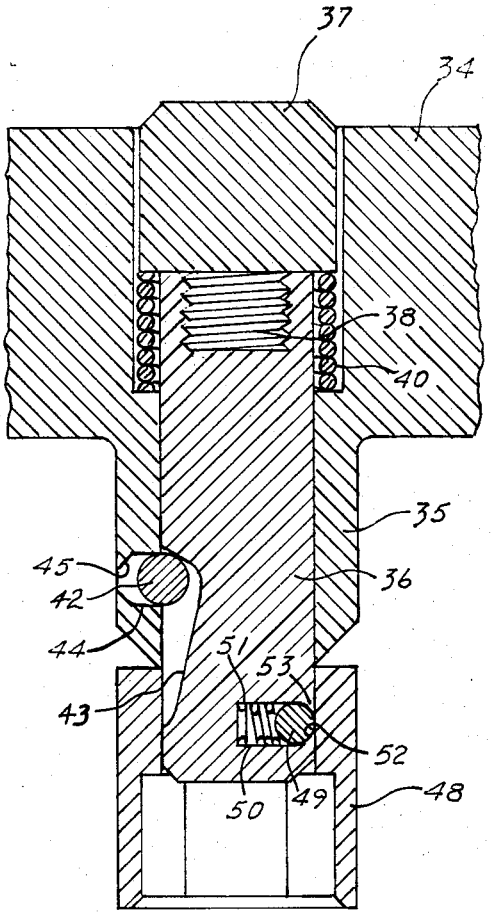
FIG. 5 is a sectional view similar to FIG. 2 illustrating a modification of the invention.

Referring now to the drawings, FIG. 1 illustrates a wrench handle 10 of the ratchet type, which includes a ratchet housing or head 11 and a grip of lever 12 extending therefrom for rotating the wrench. Ratchet handles are well known and a detailed showing and description of the ratchet mechanism are not essential to an understanding of the present invention. The ratchet mechanism may be of the type affording operation in either direction so that nuts or bolt heads may be tightened or loosened by selecting the direction of operation of the ratchet.

The ratchet handle 10 has a projecting member, generally indicated by the numeral 13, which is provided to engage and hold the selected socket wrench. The upper portion of the projection 13, indicated at 14, is driven by operation of the handle 12 through the ratcheting action of the head 11. The projecting portion 14 terminates in a section 15 which is of square cross section so that it will fit the square coupling sockets of one set of socket wrenches. When a socket wrench is fitted on the section 15, it is held in place frictionally by the pressure of a spring pressed ball or detent 16 which is held in section 15 by a retainer **16*a***.

A bar 17, of square cross section, is slidably mounted within the projection 13 and is movable axially of the projection from the position shown in full lines in FIG. 1 to a second position, indicated in dotted lines, at the top of the housing 11, the bottom end of the bar then being positioned flush with the bottom of section 15. In this position the bottom end of the bar is out of the way of the nut or bolt head to be turned by the wrench. This position of the bar is illustrated in FIG. 3 which shows a socket wrench 18 held on the section 15 of the projection 13, pressure being exerted by the ball 16 urged by its spring 19.

The two positions of the bar 17 are determined by two spring pressed balls or detents 20 and 21, their springs 22 and 23, respectively, urging the balls outwardly against the projection section 15. The spring and balls are mounted in radial recesses 24 and 25 and are retained in place by rings or shoulders 26 and 27, respectively. When the bar 17 is in the position of FIG. 2 the balls 20 and 21 engage shallow recesses 28 and 29 in the wall of the projection portion 15.

When the bar 17 is moved downwardly to the position of FIG. 1 the ball 20 is engaged in the recess 29 and the ball 21 is outside the projection portion 15 in a position to engage the wall of a square coupling socket 30 of a socket wrench 31. The ball 21 then is pressed against the wall of the coupling socket and holds the socket wrench in position on the end of the bar 17.

The movement of the bar 17 may be limited by a longitudinal slot 32 in the projection portion 15, as shown in FIGS. 1 and 4 and in which a set screw 33 threaded in the bar 17 is positioned; thus the screw 33 moves along the slot 32 when the bar 17 is shifted and the length of the slot determines the range of movement of the bar. The set screw 33 is removed when the bar 17 is to be removed from the projection 13.

From the foregoing, it will be apparent that the ratchet handle 10 may be used interchangeably for turning socket wrenches having two different sizes of coupling sockets, this being accomplished by mounting the larger coupling socket on the extension portion 15 or the smaller coupling socket on the bar 17 when in its lower and projected position. Thus a single ratchet wrench may be used with the socket wrenches of either of two sets of socket wrenches each set having a different size of coupling sockets.

Figure 6:
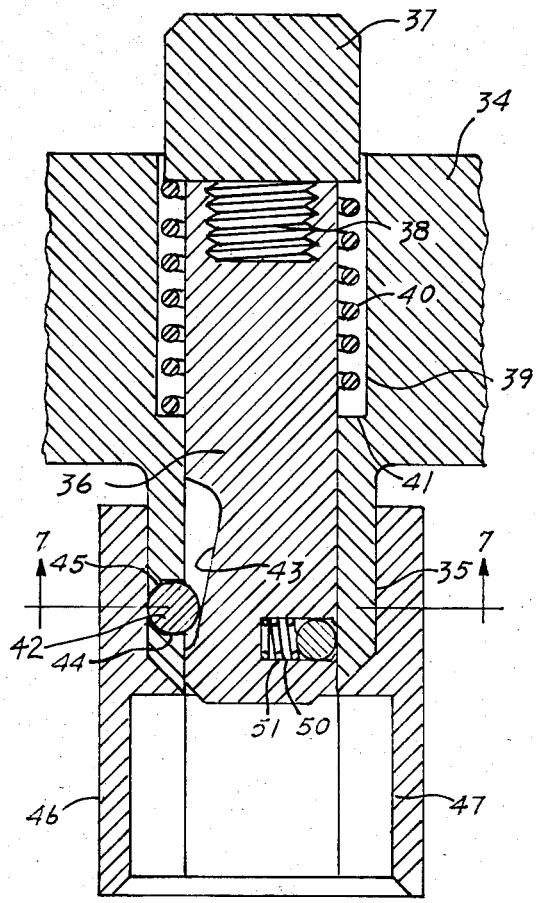
FIG. 6 is a sectional view like that of FIG. 5 with the central bar retracted and a socket wrench having a larger coupling head attached thereon.
Figure 7:
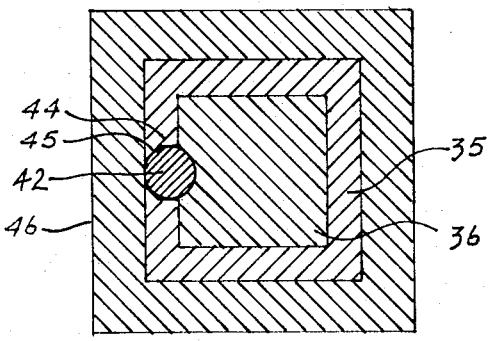
FIG. 7 is a sectional view along the line 7—7 of FIG. 6.

The modification of the invention illustrated in FIGS. 5, 6 and 7 employs a ratchet handle essentially similar to that illustrated in FIG. 1. The ratchet handle includes a ratchet housing or head 34, shown broken away, and which has a downwardly projecting portion 35 in which a rod or bar 36 is slidably mounted for movement axially of the head 34. The rod 36 is of square cross section as indicated in FIG. 7 and the projection 35 is also of square cross section as shown in FIG. 7. The cross section of the rod 36, and the projection 35 are of sizes selected to fit the coupling recesses of two different sets of socket wrenches. The bar 36 is provided with a head 37 which is attached to the upper end of the rod by a threaded connection 38. The bar 36 passes through an enlarged section of the bore, indicated at 39, and a biasing spring 40 is arranged between the head 37 and a shoulder 41 on the inner face or wall of the head 34. The spring 40 biases the rod to an upward position and its upward movement is stopped by engagement of a ball 42 with the wall of a camming recess 43 formed in the rod. The ball 42 is retained in a hole 44 in the projection 35; the outward movement of the ball is limited by a ring 45 formed about the entrance of the hole and which prevents the ball from leaving the interior of the projection 35. When a socket wrench such as indicated at 46 is placed over the projection 35 it engages the ball 42 and presses it inwardly against the spring bias of the bar; the pressure of the camming surface 43 against the ball 42 urges the ball outwardly and thereby holds the socket 46 in place against unintentional removal from the projection 35. The socket 46 may be released from the projection 35 by pressing the head 37 of the bar 36 downwardly so that the enlarged upper end of the recess 43 allows the ball to move away from its engagement with the socket 46; the socket may then be removed easily from the wrench by pressing the rod 36 downwardly thereby engaging a part of the wall of the hexagonal recess 47 in the socket 46 and dropping the socket from the wrench.

When the socket 46 has been removed from the projection 35, the bar 36 may be extended farther below the projection 35 and a socket 48 having a smaller recess that fits the lower end of the bar 36 may be pressed over the lower end of the bar. This position, as indicated in FIG. 5 is such that a ball 49 in a hole 50 is urged by a spring 51 into, a shallow recess 52 on the interior wall of the socket 48. The ball 49 is retained in position in the hole 50 by a ring or projection 53 near the outlet of the hole 50 through which the ball projects slightly to engage the bar, the projection 53 prevents release of the ball from the hole 50 when the socket is removed from the bar 36. In the lower position of the bar, when the ball 49 is in engagement with the socket 48, the bar is held in its lower position with the spring 40 compressed, the pressure on the ball 49 against the socket 48 being sufficient to prevent the return of the bar 36 to its upper position until the socket 48 has been removed.

From the foregoing it will be seen that the modification of the invention shown in FIGS. 5, 6 and 7 provides the same advantages as the modification of FIGS. 2, 3 and 4 and further provides a quick release of the larger socket. Should it be desired to remove the bar 36 from the wrench head 34, the head 37 may be unscrewed and removed and the spring 40 released, thereby releasing the spring pressure on the ball 42. The ball can then be moved away from the retainer ring 45 and the ring may then be cut or ground away or otherwise removed and the ball taken out to free the path of the bar so that it may be removed.

While the invention had been illustrated and described in connection with particular ratchet wrench constructions other applications and modifications will occur to those skilled in the art and it is intended by the appended claims to cover all modifications which fall within the spirit and scope of the invention.

We claim:

1. A ratchet handle having a projection for engaging a detachable socket wrench having a coupling recess for receiving said projection, a spring pressed detent mounted in said projection for frictionally retaining a socket wrench thereon, said projection having an axial passage extending therethrough, a bar slidably mounted within said passage in sliding engagement with said projection, the wall of said passage having two axially spaced and longitudinally aligned depressions therein, spring pressed detents mounted on said bar and spaced for concurrent engagement with said bar in respective ones of said two depressions, said bar having its end adjacent said projection shaped to fit in the wrench coupling recess of a detachable wrench socket smaller than the coupling recess of said first mentioned socket wrench, said bar being slidable outwardly of said projection and into a position wherein the one of said detents nearer the end of said bar lies outside said projection and the other of said detents engages the bar in the one of said depressions near the outer end of said projection to hold said bar in its outwardly extended position and wherein said one detent is positioned to engage and retain a socket placed on the outer end of said bar, whereby said ratchet handle may be used interchangeably with the sockets in two sets of sockets having wrench coupling recesses of respective different sizes and which fit on said projection and on said end of said bar respectively.

2. A ratchet handle for use with socket wrenches of the type having a coupling socket at one end and a nut or bolt head engaging socket at its other end, said handle having a ratchet head and a socket driving projection for insertion in the coupling socket of a socket wrench and a spring pressed element mounted in said projection and extending outwardly for frictionally retaining the socket wrench on said projection, said projection having an axial passage extending therethrough, a bar mounted within said passage in sliding engagement with said projection and being of a length to extend through and beyond said ratchet head in one position and beyond said projection in its other position, the wall of said passage in sliding engagement with said projection having two axially spaced and longitudinally aligned depressions therein, two spring pressed detents mounted on said bar and spaced for concurrent engagement with respective ones of said depressions to hold said bar retracted within said projection with its remote end extending beyond said ratchet head, the end of said bar adjacent said projection being of a size and configuration for driving engagement with a coupling socket smaller than that mountable on said projection, said bar being slidable outwardly of said projection and into a position wherein the one of said detents nearer the end of said bar lies outside said projection and the other of said detents engages the bar in the one of said depressions near the outer end of said projection to hold said bar in its outwardly extended position and said one detent is positioned to engage and frictionally retain a socket wrench placed on the outer end of said bar, whereby said ratchet handle may be used interchangeably with the socket wrenches of two sets of socket wrenches having coupling sockets of respective different sizes and which fit on said projection and on said end of said bar respectively.

3. A ratchet handle as set forth in claim 2 including an axially extending slot in said projection and a screw threaded in said bar and having its head in said slot for limiting the range of movement of said bar.

* * * * *